US007497034B2

(12) United States Patent
Emerson et al.

(10) Patent No.: US 7,497,034 B2
(45) Date of Patent: Mar. 3, 2009

(54) SNOWSHOE BINDING WITH TOP BUCKLES

(75) Inventors: Daniel T. Emerson, Berkeley, CA (US); Rudy Lucas Samuels, Los Angeles, CA (US)

(73) Assignee: K-2 Corporation, Seattle, WA (US)

( * ) Notice: Subject to any disclaimer, the term of this patent is extended or adjusted under 35 U.S.C. 154(b) by 471 days.

(21) Appl. No.: 11/335,862

(22) Filed: Jan. 18, 2006

(65) Prior Publication Data

US 2007/0163155 A1 Jul. 19, 2007

(51) Int. Cl.
*A43B 5/04* (2006.01)

(52) U.S. Cl. ..... 36/124; 36/125

(58) Field of Classification Search ..... 36/123–125
See application file for complete search history.

(56) References Cited

U.S. PATENT DOCUMENTS 3,965,584 A 6/1976 Beaulieu
5,259,128 A 11/1993 Howell
5,918,387 A * 7/1999 Emerson ..... 36/122
6,374,518 B2 * 4/2002 Warner ..... 36/124
6,814,360 B2 * 11/2004 Kiniry et al. ..... 280/11.3
2003/0101623 A1 6/2003 Settelmayer
2003/0167657 A1 9/2003 Kiniry et al.
2004/0231200 A1 * 11/2004 Forrest et al. ..... 36/122

* cited by examiner

*Primary Examiner*—Ted Kavanaugh
(74) *Attorney, Agent, or Firm*—Thomas M. Freiburger

(57) ABSTRACT

A binding for a snowshoe has, in several different embodiments, a pair of straps to draw the binding tight over a user's boot, the two straps reversing direction at side loop points and being secured to a pair of buckles on a floating tongue at the top of the binding, generally over the ball area of the foot. In one form the straps are anchored at toe points on the binding and extend back in a crossing, X configuration, as in U.S. Pat. No. 6,814,360. In another form the straps are shorter and do not cross, the forward ends being replaced with toe-cradling strap-like members that extend up and back and come together at a pivot connection with a tongue, in this case a shorter tongue, to which the two buckles are connected. The binding tends to open with release of the straps. In a third form the tongue is a larger, padded X-shaped flexible member under which the boot is slid to engage the binding. Front elements provide a hinged, springing action that lifts the tongue off the boot, opening the binding, when the two buckles are released. A modular footbed is also disclosed, capable of receiving a series of different front ends for different bindings.

24 Claims, 12 Drawing Sheets

SNOWSHOE BINDING WITH TOP BUCKLES

BACKGROUND OF THE INVENTION

This invention concerns snowshoes, and relates to an improved boot binding for a snowshoe.

This invention primarily provides improvements over U.S. Pat. No. 6,814,360, owned by the assignee of the current invention, that patent being fully incorporated herein by reference. In that patent, a snowshoe binding had a minimal lower shell or footbed structure and included two straps, extending from left and right toe stop positions at front, extending back in an intersecting X configuration, then each passing over respective loops on the shell at lateral upward positions, then returning to a floating "buckle island" where the two buckles were located (see FIG. 1). The two buckles were connected back to back with a short spacing between them and "floated" over the boot or shoe, generally above the ball of the foot and adjacent to the shoe's lacing. (The terms "boot" and "shoe" are intended to be understood interchangeably.)

The current invention encompasses improvements to the binding described in the '360 patent, to better and more stably engage the boot, to maintain positioning of the straps and in some forms to lessen the length of straps, and to provide greater convenience to the user in securing the shoe in the binding and comfort to the user in use of the snowshoes.

SUMMARY OF THE INVENTION

In the current invention a binding for a snowshoe has, in several different embodiments, a pair of straps to draw the binding tight over a user's boot, the two straps reversing direction at side loop points and being secured to a pair of buckles at the top of the binding, generally over the ball area of the foot. In one form the straps are anchored at toe points on the binding and extend back in a crossing, X configuration, then each passes through the reversal loop at opposite sides of the binding and then centrally to the respective buckle at the top of the binding, as in U.S. Pat. No. 6,814,360. The two buckles are close together and are secured to a flexible tongue that is connected over the crossing intersection of the straps, organizing the straps an permitting sliding through the tongue. The tongue has a back-end tab which, when the buckles are released, can be pulled to loosen the binding.

In another form the straps are shorter and do not cross, the forward ends essentially being replaced with rubbery boot toe-cradling strap-like members that extend up and back and come together at a pivot connection with a tongue, in this case a shorter tongue, to which the two buckles are connected. The tongue in both this and the first-described form "floats" and affords adjustability as to different shoe lengths.

In a third form the tongue is replaced with a larger padded X-shaped flexible top member or tongue under which the boot is slid to engage the binding. A stiffening rib at front, secured to footbed toe stops, provides a springing action that tends to lift the top member off the boot, opening the binding, when the two buckles are released. In all forms the binding can include a loop to connect to the release levers of the two opposed top buckles, enabling the wearer simply to pull up on the loop to release, which will also pull the tongue upwardly causing the binding to open.

Another improvement over the '360 patent is that more-rigid side wings are included in the binding to-cradle the portion of the user's shoe at the arch and somewhat behind. This utilizes rearwardly extending support arms or control wings preferably integrally formed with the footbed and generally as disclosed in U.S. Pat. No. 5,259,128, owned by the assignee of this invention and also incorporated herein by reference.

A modular footbed is also disclosed, capable of receiving a series of different front ends for different bindings.

It is thus among the objects of the invention to improve the comfort, ease of use, reliability and stability of a binding on a snowshoe, as well as to facilitate efficient manufacture. These and other objects, advantages and features of the invention will be apparent from the following description of preferred embodiments, considered along with the accompanying drawings.

DESCRIPTION OF PREFERRED EMBODIMENTS

Figure 1:
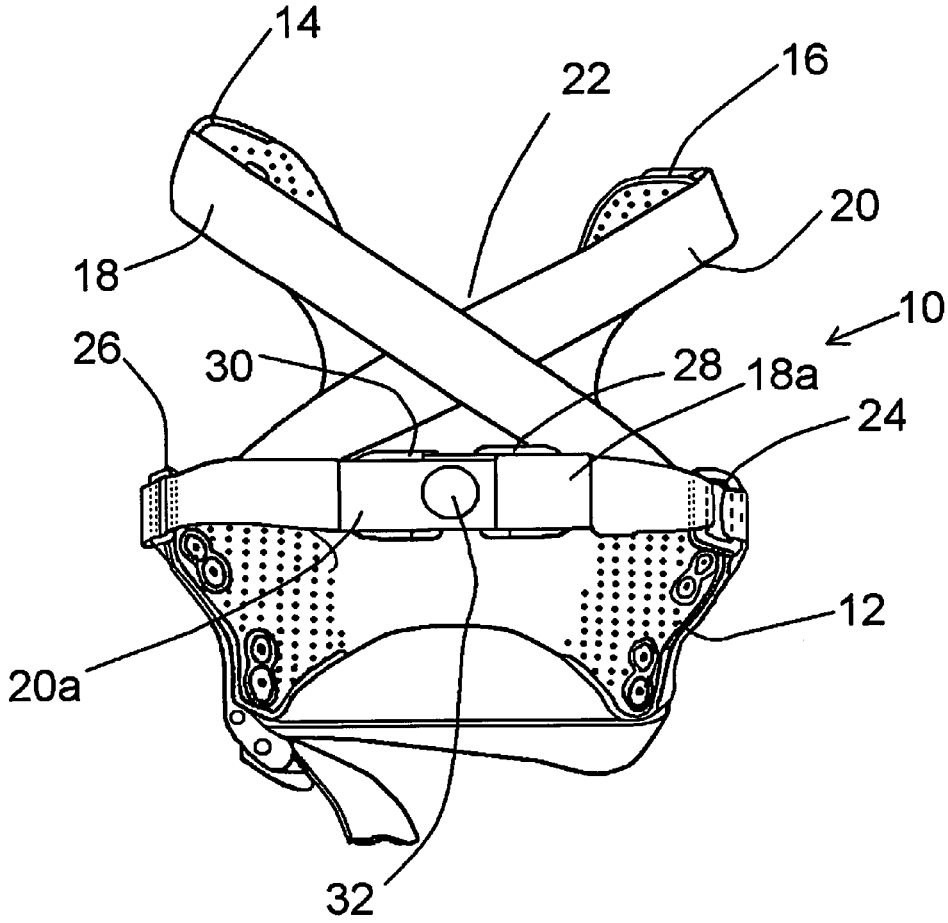
FIG. 1 PRIOR ART
FIG. 1 is a plan view showing a snowshoe binding of the prior art.

FIG. 1 shows a snowshoe binding, without the snowshoe, in a configuration as disclosed in U.S. Pat. No. 6,814,360 referenced above. This type of binding 10 comprises a shell or harness shell 12 that acts as a footbed for the user's shoe and includes, either attached or integral, front toe stops 14 and 16. A pair of straps 18 and 20 are secured to and extend upwardly and back from the toe stops 14 and 16. As FIG. 1 shows, these straps intersect at 22 in an X configuration, then each goes to the opposite side and passes through a low-friction slide loop, the loops being shown at 24 and 26. From here the two straps each essentially reverse direction and pass through a respective buckle, shown at 28 and 30 on the drawing. The straps have tails 18*a* and 20*a* that extend out from the buckles 28 and 30 and are pulled by the user in opposite directions to tighten the binding onto the boot. In the particular embodiment shown in FIG. 1, the two strap tails are connected together above the buckles, as by a snap 32. The two buckles are retained together, spaced a short distance apart as shown, and "float" above the user's boot.

Figure 2:
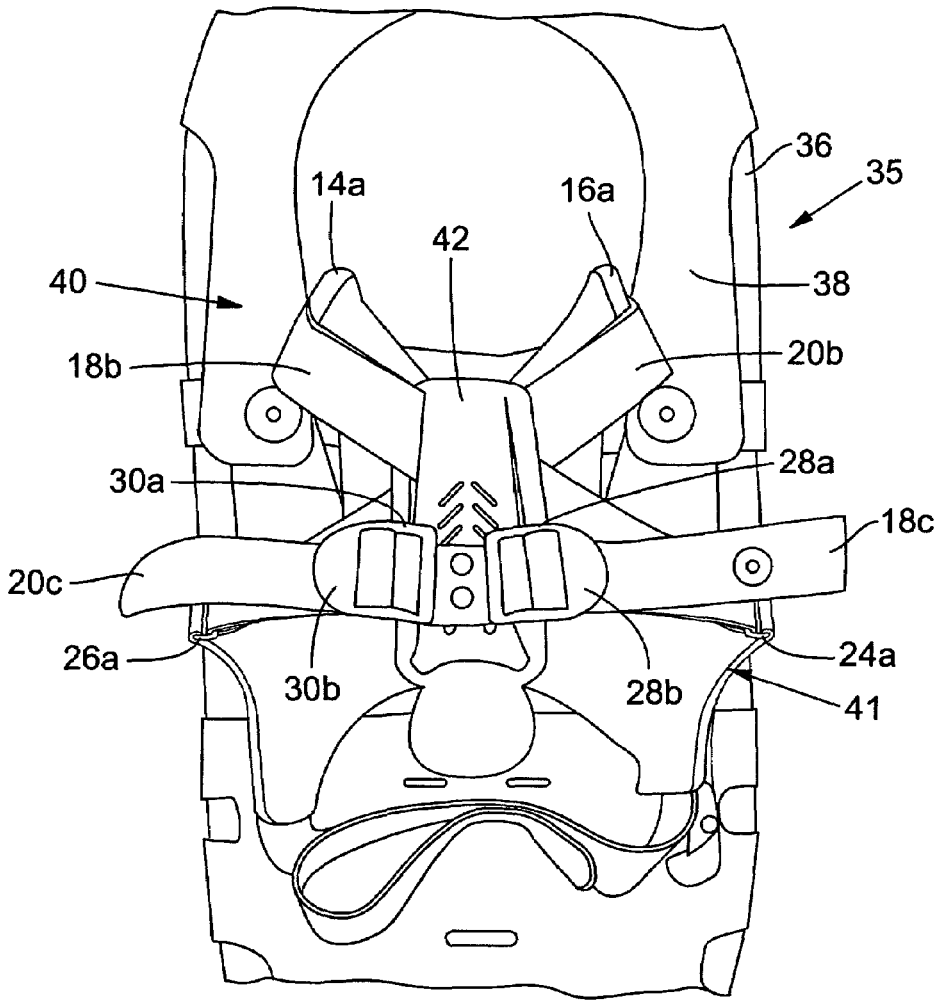
FIG. 2 is a plan view showing an improved binding according to the invention, in a first embodiment.

FIG. 2 shows in plan view a modification of the prior art binding, in a first embodiment of the invention. A snowshoe 35 has a frame 36 and decking 38. Suspended on the frame, preferably on a pitch pivot, not shown, is a binding 40 which includes a base or shell 41 to receive the shoe of the user. The shell 41 has a forward end with a pair of toe stops 14*a* and 16*a*, which can be generally similar to those shown in the prior binding of FIG. 1. Again, a pair of straps 18*b* and 20*b* cross over one another at an intersection, then each extend back and to the opposite side to pass through a relatively low-friction loop 24*a*, 26*a*. The two straps then converge toward the center as shown, pass through buckles 28*a* and 30*a*, reverse direction and extend outwardly as strap tails 18*c* and 20*c*. In this configuration, however, a rubber or rubbery plastic, pliable tongue member 42 provides guidance for the straps in the area where they intersect and provides a firm mounting for the two buckles 28*a* and 30*a*. The buckles can be secured directly to the tongue piece 42, as by rivets, or they can be connected to a short piece of strapping, which is connected to the tongue piece. In either event the two buckles 28*a* and 30*a* preferably have some flexibility as to position, such as being pivotally connected to the tongue 42 or being connected thereto by a flexible element. The buckles can be ladder lock type buckles, another type of friction buckles, or cam lock buckles. In any event, they are of a type which allow tightening by pulling the strap tails without excessive friction through the buckles, the straps then being firmly held against retraction. Each buckle has a lever 28*b*, 30*b*, which releases the strap when pulled upwardly at the outer end of the buckle. See FIGS. 3 and 4, also showing this configuration of binding.

Figure 3:
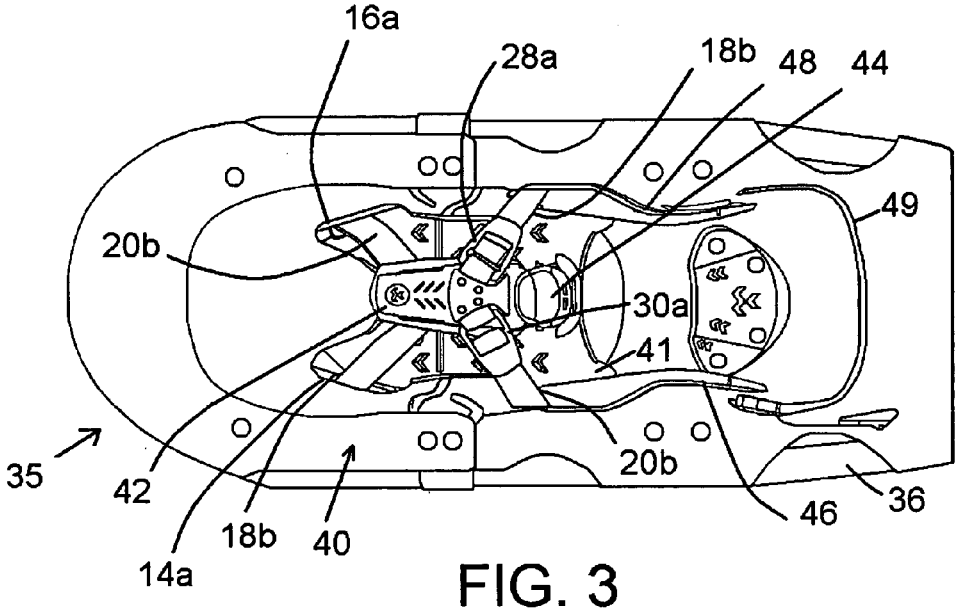
FIG. 3 is another plan view of the binding shown in FIG. 2.
Figure 4:
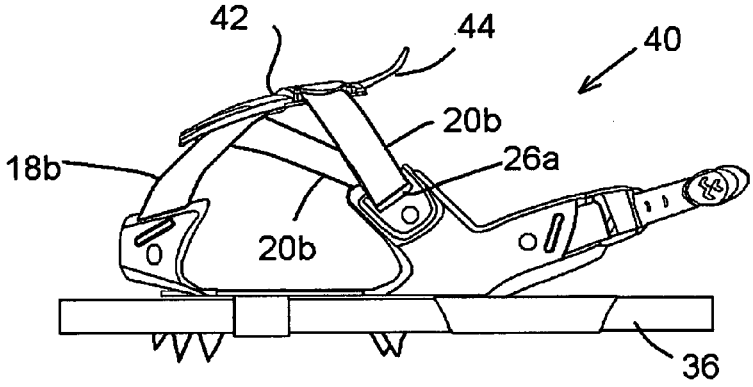
FIG. 4 is a side elevation view of the binding shown in FIG. 2.

As seen in FIGS. 2-4, the forward portions of the straps 18*b* and 20*b* are guided by a forward end of the tongue piece 42. At least one slot is formed in the bottom side of the tongue 42, through which the straps pass with low friction. The tongue 42 keeps the straps in position and organized, preventing disarray in the straps which could otherwise occur when the binding is fully released and opened and the straps are loose.

FIGS. 3 and 4 show that the straps 18*b* and 20*b* can angle forward in approaching the buckles 28*a* and 30*a*, at least in one position of the binding. The floating tongue adjusts position with different user shoe sizes, thus accommodating a range of sizes, an important feature. The buckles are preferably held to the tongue member 42 by pivotable connections, accommodating the different positions of the tongue.

The drawings also show a rear tongue tab 44 preferably included on the tongue 42, for the purpose of-pulling upwardly at the back of the tongue to release the straps of the binding. When the wearer releases the binding, this is done by first pulling up the levers on the buckles to release the lock of the buckles on the straps, then by pulling up the tongue tab 44 to loosen the straps further and open the binding.

FIGS. 3 and 4 also show that the binding preferably includes a pair of "control wings" 46 and 48 extending toward the rear from the base or footbed 41. These control wings are somewhat similar to those shown in the above referenced U.S. Pat. No. 5,259,128, and preferably are integrally formed with the base 41 or shell of the binding. In the current embodiment, however, the control wings preferably are more contoured to the shoe or boot. As in the '128 patent binding, the control wings support a rear strap 48 of the binding. The importance of the control wings is in providing a more stable securement of the shoe than in the case of a flexible and pliable shell or base. The shoe is firmly positioned between the two toe stops 14*a* and 16*a* at the front of the binding and between the two control wings 46 and 48 at the rear, as well as being engaged by the rear strap 49. The straps 18*b* and 20*b* are connected to forward top ends of the control wings, passing through loops 24*a* and 26*a*, and thus draw the control wings close against the boot when the straps are tightened.

FIGS. 5 through 9 show a second form of binding according to the invention, wherein the straps are shorter but function in essentially the same way in tightening the binding. The binding 50 is shown without the snowshoe frame and decking. Here, a modified tongue 52 is secured to extended front toe stops 54 and 56 that are rubbery and pliable, although springy and tending to straighten. These toe stops preferably are integral extensions of the footbed 58, or of a forward nose portion 58*a* of the footbed in a modular and interchangeable footbed embodiment described further below. The two toe stops 54, 56 are connected by a fastener such as a rivet 60 tied to the tongue 52, preferably allowing some degree of pivoting. Again, buckles 28*c* and 30*c* are slightly spaced apart and secured to the tongue 52, preferably by pivot-permitting fasteners as shown. Again, the tongue 52 position adjusts fore/aft to conform to different shoe sizes. The straps 62 and 64 function in essentially the same manner as described above in tightening the binding, but in this case they are anchored at the front of the tongue, preferably at the fastener 60. In essence, the bending, pliable toe stop 54 (which is integral with the footbed) replaces what would otherwise be the front portion of the strap 64 if the straps were arranged as in the previous embodiment. The difference is that the pliable toe stops 54 and 56 do not draw over the boot in the same manner as straps, but are fixed together at the point 60 and function more as an adjustable toe harness unit, still with considerable freedom of movement to conform against-and tighten down to the boot when the straps are tightened, and capable of receiving a range of shoe sizes. The straps 62 and 64 thus stay on their respective sides of the binding, without crossing each other, and pass through a low-friction loop 26*b* at each side of the binding, preferably mounted on the upper end of a control wing 46, 48 at each respective side. Tail ends of the straps 62*a* and 64*a* are shown extending from the buckles in FIGS. 5, 6 and 7, these tail ends not being shown in FIGS. 8 and 9.

Figure 15:
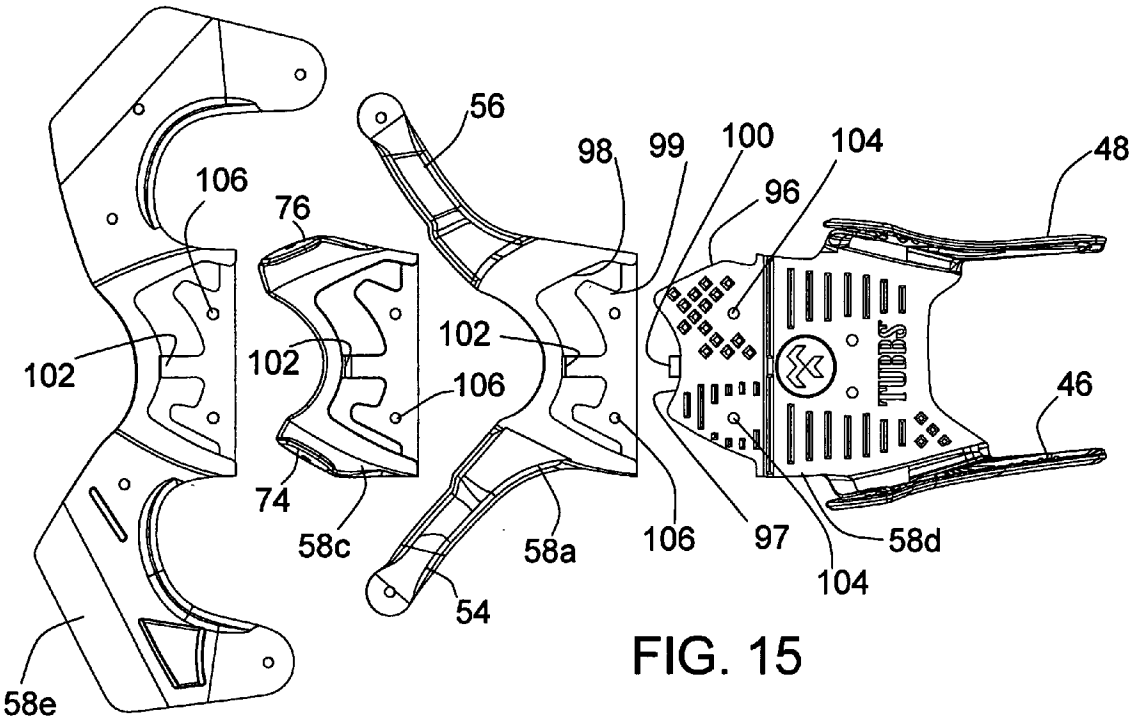
FIG. 15 is a plan view, exploded, showing a footbed base module and three different footbed nose modules that can be assembled to the common base module in a binding of the invention.

This is a simpler and more efficient design than the form shown in FIGS. 2-4, in that the straps are shorter and need not pass through as much friction in tightening, and in loosening, the-binding. Moreover, the binding tends to spring open when the buckles are released, because, as noted above, the toe stops 54 and 56 act as springs, attempting to assume more straightened configurations when not bound down against the boot. They may be injection molded generally in a plane with nose piece 58*a*, as seen in FIG. 15. Thus, even though still confined by the connection at 60 to the tongue, these toe stops will spring the tongue upwardly as soon as the binding is released, making insertion and removal of the shoe from the binding easier and more convenient. The extended toe stops 54 and 56 act together as a stiffening rib, in a manner somewhat similar to the embodiment described below.

Figure 5:
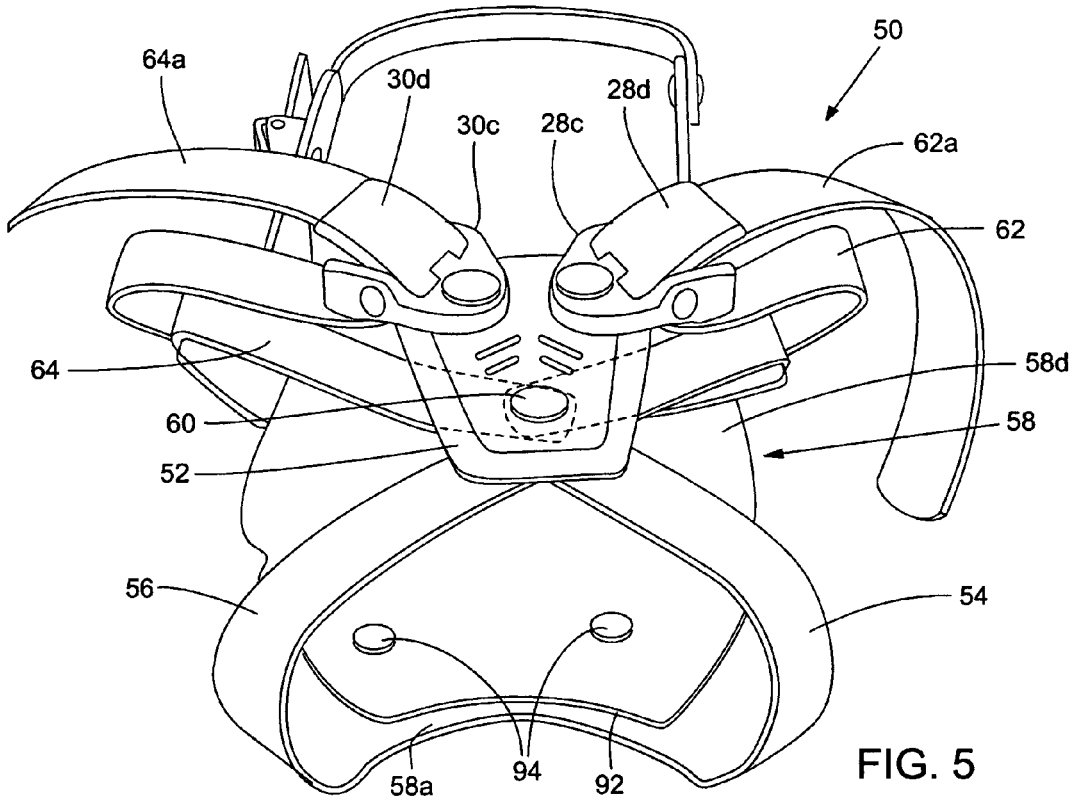
FIG. 5 is a front perspective view showing a binding of the invention in a second embodiment.
Figure 6:
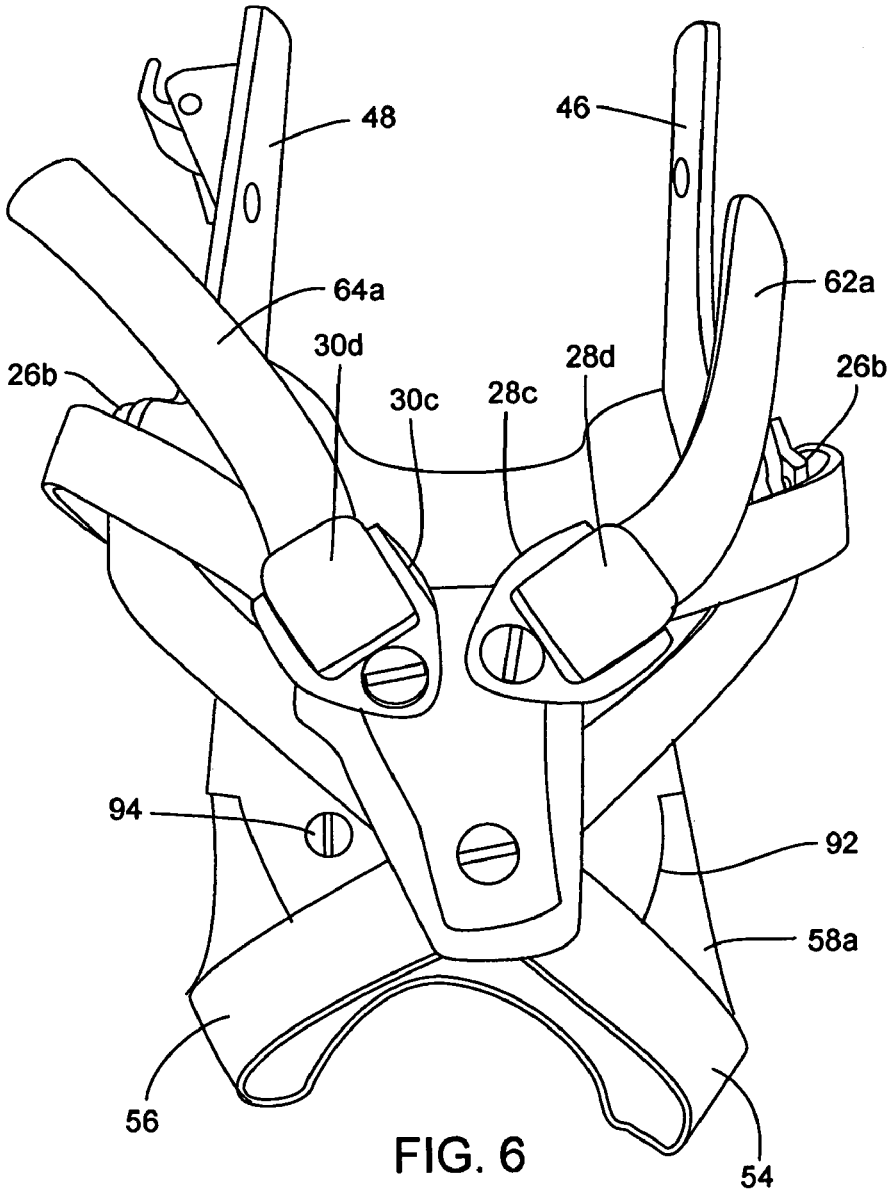
FIG. 6 is a plan view showing the binding of FIG. 5.
Figure 7:
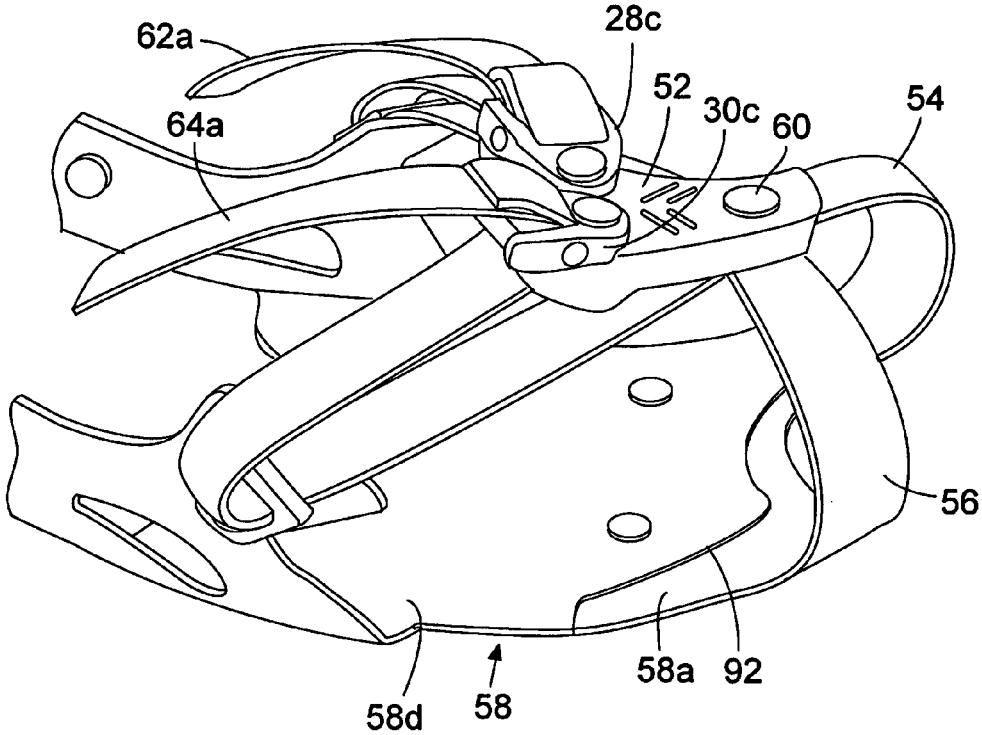
FIG. 7 is a side perspective view showing the binding of FIG. 5.
Figure 8:
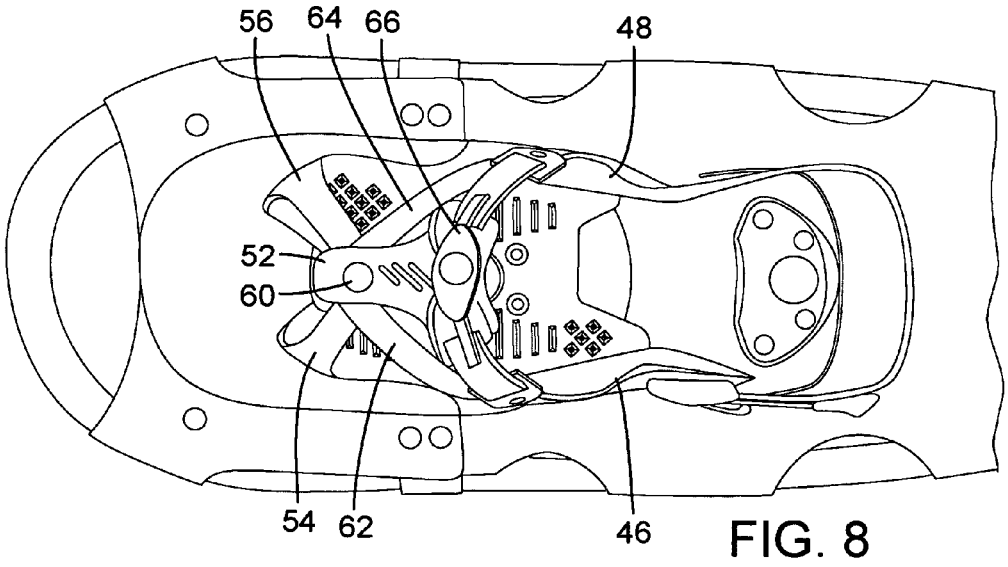
FIG. 8 is another plan view showing the binding of FIG. 6, on a snowshoe.
Figure 9:
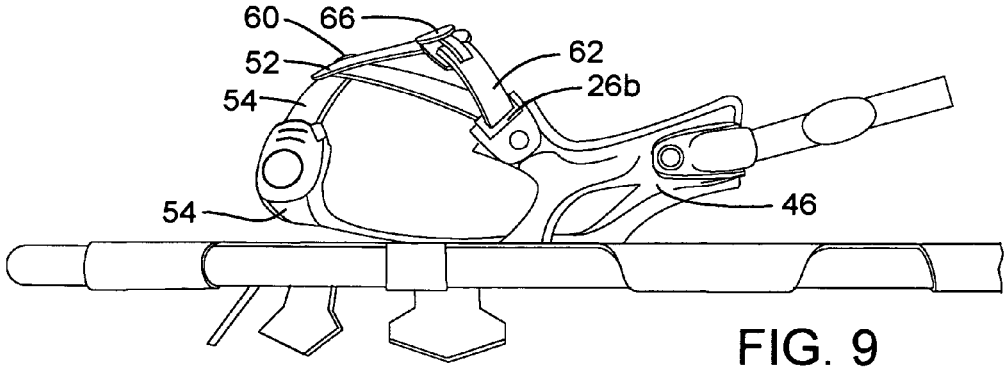
FIG. 9 is a side elevation view of the binding and snowshoe of FIG. 8.

Another preferred feature of this form of binding is a quick-release for the buckles. Buckle levers 28*d* and 30*d* are shown in FIGS. 5-7. As described previously, these are pulled up at their outer ends to release the straps. In FIGS. 8 and 9 a buckle release loop 66 is shown secured to the two buckle levers. This enables the user, with a single upward pull, to release both buckles, loosening the straps, while also pulling up on the tongue 52 to further loosen the straps. This quick release is also aided by the upward/forward springing action of the-toe stops 54 and 56. The buckle release loop can also be included in the binding of the first embodiment described above, if desired.

Figure 10:
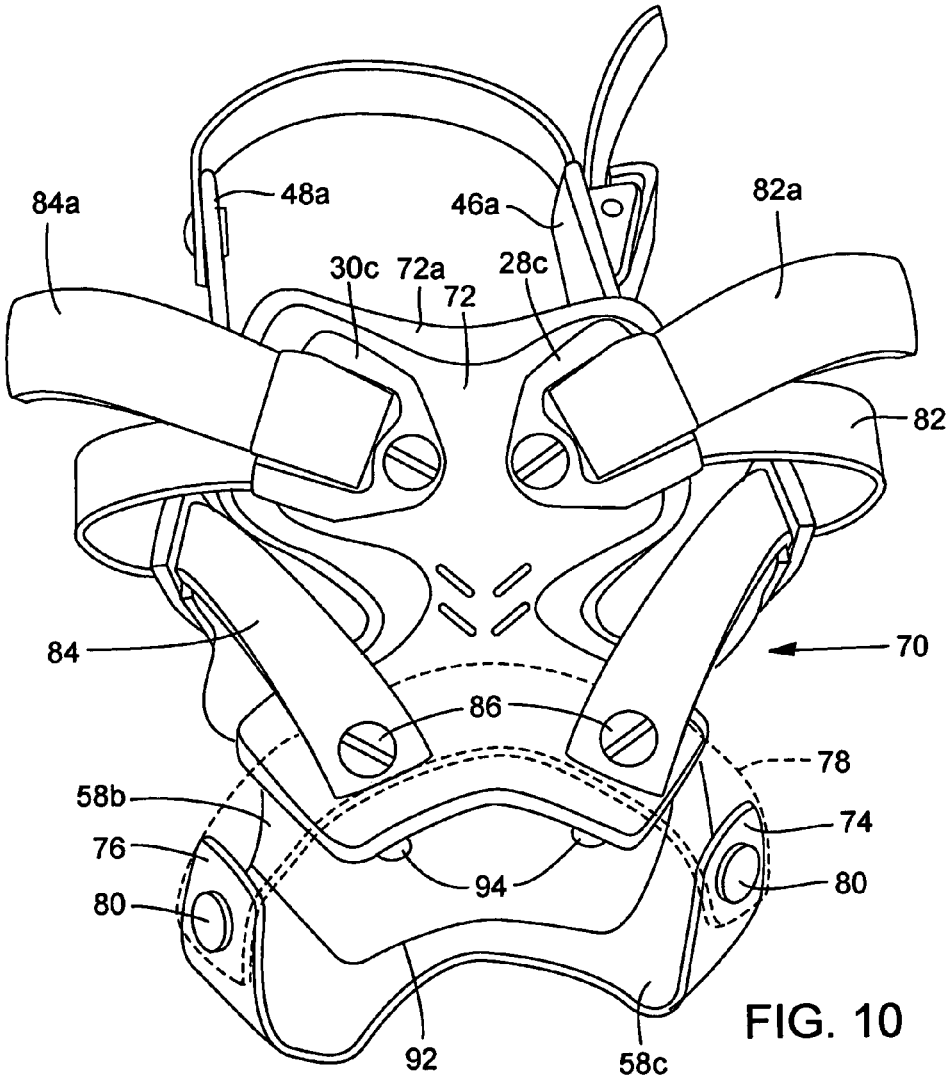
FIG. 10 is a frontal perspective view showing a third form of improved binding according to the invention.

FIGS. 10-14 show a further variation of the invention. Here, a binding 70, shown disconnected from a snowshoe, has a larger, padded, flexible and rubbery tongue 72, which can be in generally an X configuration as seen in FIG. 10. A strap pattern is similar to but slightly different from that of the above described form of binding. Here, the footbed 58*b*, which can be a modular footbed as described below, has a different front end or nose module 58*c*. Short toe stops 74 and 76 extend up integrally from the footbed. These toe stops may be somewhat more rigid than the longer toe stops 54 and 56 of the above described form of binding, and may extend up approximately 1½ inch from the footbed. To the toe stops is secured a generally arch-shaped stiffening rib 78 as shown in FIG. 10. The stiffening rib in FIG. 10 is shown as partially transparent, to assist in understanding the construction.

The stiffening rib 78 is secured to the two toe stops 74, 76 preferably in pivotal connections, as by rivets 80, to form a type of hinged release or nose hinge for the binding. Both the stiffening rib and the toe stops are deflected when the binding is drawn down. When the binding is released the toe stops tend to spring outwardly and the stiffening rib 78 to straighten from its warped and arched configuration. This has the desired effect of springing the tongue member 72 upwardly when the straps are released, quickly releasing and opening the binding for removal and insertion of a shoe. It is the tendency of the toe stops 74, 76 and the arch-shaped stiffening rib 78 to return to their undeformed configurations, that causes the tongue to be lifted upwardly on release of the straps.

Although larger than in the other forms described, the tongue 72 still has some fore/aft adjustability movement. A larger, taller boot placed into the binding will hold the tongue higher and more forward, and the buckles and straps accommodate this with the buckles pivotally secured to the tongue.

As seen in FIGS. 10-14, the straps 82 and 84 in this embodiment do not intersect or cross over each other, but are secured to the tongue and/or the stiffening rib 78 at connection points 86, which can provide pivoting, such as rivets or machine screws. As in the previous forms of bindings, the two straps extend back to pass through loops 26*b* on opposed sides of the binding, preferably at upper forward ends of control wings 46*a* and 48*a* as in the previously described embodiment. From there the straps go to the respective buckles 28*c* and 30*c* and have tails 82*a* and 84*a* shown extending out from the buckles in FIGS. 10-12. Again, the buckles are pivotally connected to tongue 72.

The relatively larger tongue 72 shown in this embodiment is comfortable to the wearer, being padded on the underside (at 72*a*), and cradling the top of the shoe in a stable manner that helps secure the shoe in proper orientation on the snowshoe. FIG. 12 shows a slightly modified form of tongue 72*b*, still padded but without the width at the top shown in FIGS. 10-11, 13 and 14. Also, in the form shown in FIG. 12 the stiffening rib 78*a* is integral with the tongue, as is preferred and also shown in FIGS. 13 and 14. Thus, the tongue/stiffening rib 72*b*/78*a* can be a more rigid component, to provide the needed function of the stiffening rib, while still having a padding 72*c* at the underside, for comfort against the shoe. The stiffening rib 78*a* again has an undeformed configuration that is toward a more straight or planar configuration than the arched or domed configuration assumed when the binding is tightened down against a shoe or boot 90. The stiffening rib 78*a*, as in the form described above, coacts with toe stops 74, 76 to provide the springing action, being pivotally connected together at points 80.

Figure 14:
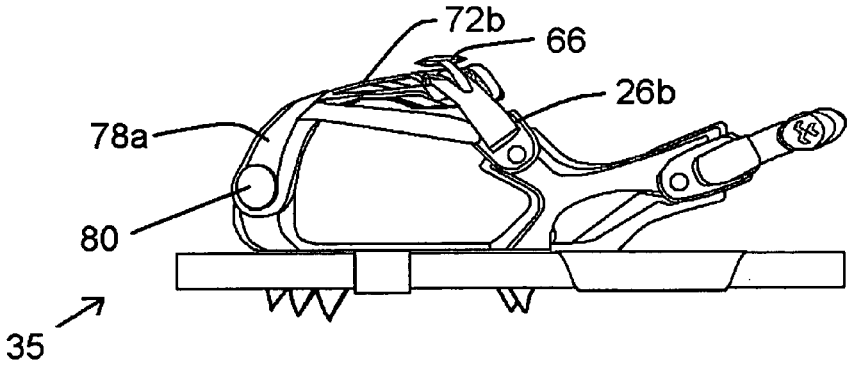
FIG. 14 is a side elevation view showing the binding and snowshoe of FIG. 13.

FIG. 14 shows a release loop that can be secured to the buckle release levers, as on the other embodiment above.

Although the stiffening rib and tongue are preferably formed integrally as just described, the device can alternatively be an integral but softer and more pliable piece of material, but with a reinforcement that comprises a stiffening rib in the arched or domed configuration described.

Figure 12:
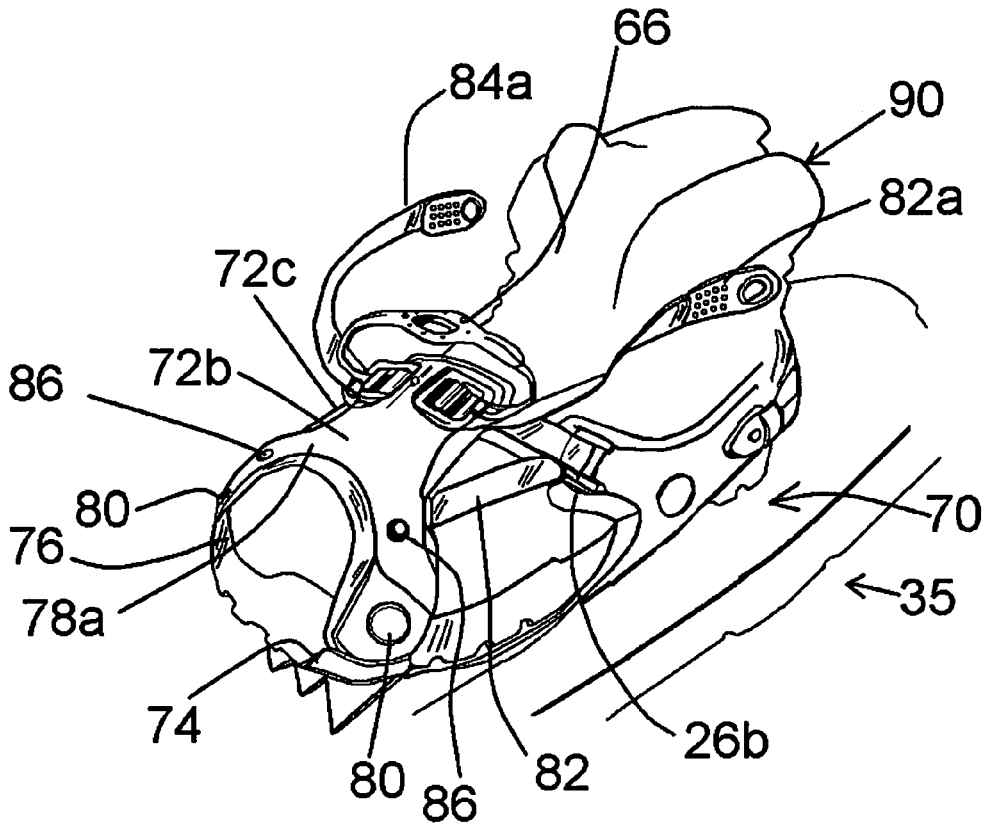
FIG. 12 is a perspective view showing the binding of the invention, similar to that of FIGS. 10 and 11.
Figure 13:
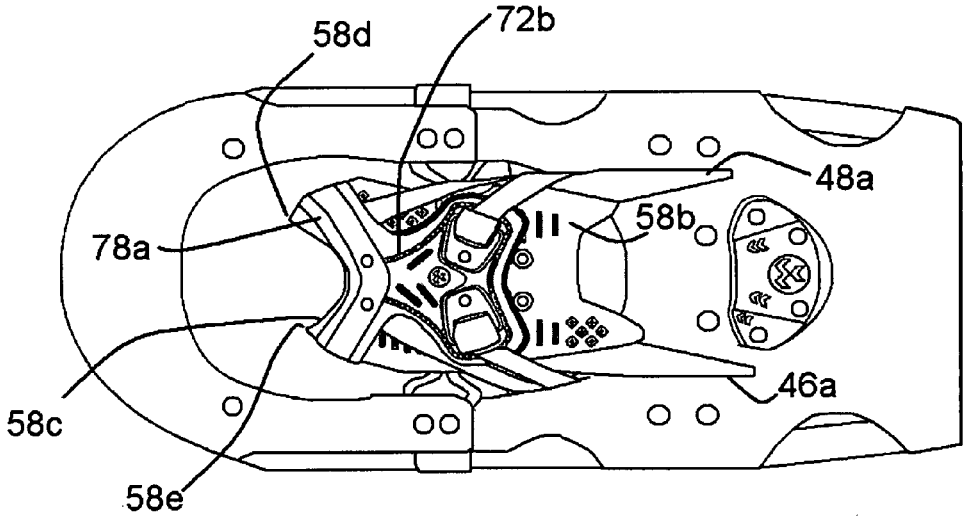
FIG. 13 is a plan view of the binding in FIGS. 10-11, secured to a snowshoe.

FIGS. 12-14 show the binding 70 connected to the snowshoe 35, preferably with provision for pivoting on the snowshoe in the pitch direction.

Figure 11:
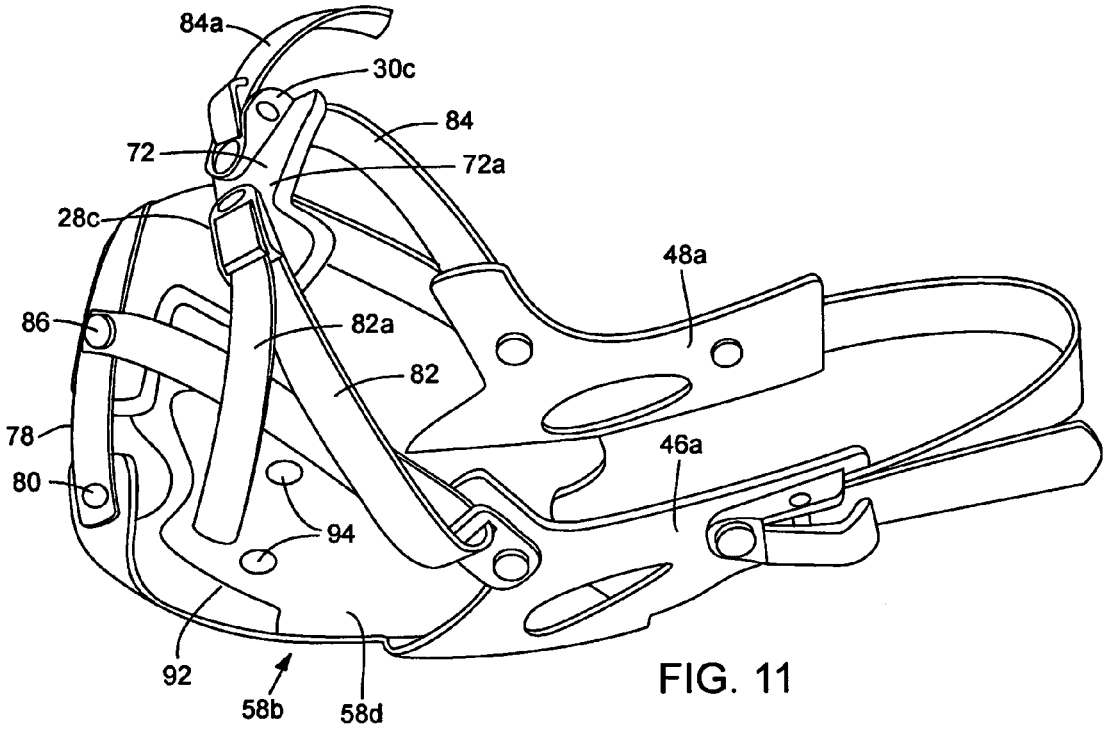
FIG. 11 is a side perspective view showing the binding of FIG. 6.

Another feature shown in FIGS. 13 and 14, and also in FIGS. 10 and 11 and in some of the drawings showing the other embodiments, is an asymmetry in the footbed/control wing structure 58*b*, or 58. As seen especially in FIGS. 10 and 13, the footbed extends farther forward on the user's right side (or medial side), for this snowshoe and binding designed for the left foot. A forward point 58*d* extends farther forward on the user's right (medial or inner side of the shoe) than a forward point 58*e* on the user's left (outer side of the shoe). At the same time, at the rear of the footbed the control wings 48*a* and 46*a* are at non-symmetrical positions. The inner side control wing 48*a* is positioned for snug engagement with the arch, while the outer control wing 46*a* engages against the shoe slightly farther back, where the shoe tends to narrow near the heel. This asymmetrical configuration is to assure the foot becomes aligned with the center of the snowshoe. Shaping the control wings to better contour to the user's shoe tends to better center the foot and to provide better stability and rigidity for resisting rotation of the foot relative to the snowshoe. The more contoured engagement also provides for better comfort to the wearer when using the snowshoes.

Figure 16:
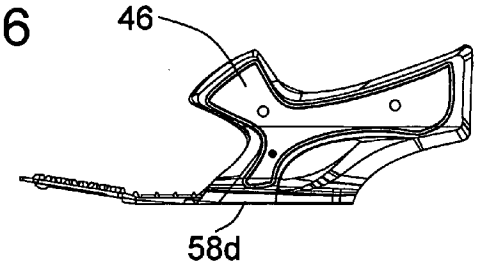
FIG. 16 is a side elevation view showing the base module of the modular footbed.

Another feature of the invention, as briefly mentioned above, is a modular footbed. The footbeds (58, 58*b*) shown in FIGS. 5 through 9, and at FIGS. 10 and 11, have different front ends, i.e. nose modules (58*a*, 58*c*). The back portion 58*d* of the footbed, however, a base module, is the same in both cases. Further variations of the nose modules of the footbed can be provided as well, depending on the length desired for the footbed, and, especially, the type of toe stops and strap arrangement to be used. This is a feature essentially not seen by the user, but one that provides versatility and modularity in manufacturing. FIGS. 15 and 16 show how the components can be assembled, in one embodiment. Also, as shown in FIGS. 5-7 and also in FIGS. 10 and 11, a break line 92 shows where the two components or modules meet, and machine screw or rivet fasteners 94 are also visible, extending vertically and securing the base portion of the footbed 58 to the end member 58*a* or 58*b*. Preferably the components are secured together by a nesting configuration and an appropriate form of tab and slot arrangement, such as illustrated in FIGS. 15 and 16. Once the fasteners 94 are secured, a permanent connection is made, which is essentially equivalent to an integral connection in the assembled snowshoe.

FIG. 15 shows a preferred embodiment, showing the base module 58*d* and three separate nose modules 58*a*, 58*c* and 58*e*. The nose modules 58*a* and 58*c* are those shown in FIGS. 5-9 and 10-11, respectively. The nose module 58*e* is not shown in the other drawings, but is for another modified binding. FIG. 16 shows the base module 58*d* in side view.

As seen in these drawings, the front 96 of the base module may have a somewhat irregular shape, with a concavity 97 that tends to follow the shape of the nose piece ahead. The nose module 58*a*, 58*c*, 58*e* has a recess 98 at its top surface for closely nesting the contour of the front end 96 of the base module, as shown. In addition, a further recessed area 99 can be included in each of the nose pieces, to nest with a relieved region on the bottom of the base's front 96, of the identical shape. This relief is not clearly seen in FIGS. 15-16, but it nests closely in the recessed area 99 of the nose module and it helps nose end base pieces fit snugly together.

Additional connection is made between base and nose with a tab 100 extending forward from the base module. This inserts into a slot 102 in each of the nose modules, locking the modules such that of the base module cannot lift relative to the front of the nose module. Finally, the base and nose modules are secured together by fasteners 94 seen in FIGS. 6, 7 and 10, for example, through holes at 104 in the base module and holes at 106 in the nose modules. At least one fastener holds the overlapped layers together, and preferably two are used. The overlap could be reversed if desired, so long as the modules are well secured together and separation is prevented at front and back of the overlap area.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A binding for a snowshoe, comprising:

a body or base member, for securing to a snowshoe, a pair of toe stops at a front of the base member, a pair of straps, each having a first, front end secured to a respective one of the toe stops, the two straps each extending back and toward the opposite side, crossing each other over a position where a user's shoe can be located, a pair of low friction strap loops on opposite lateral sides of the binding, each strap passing through one of the loops and changing direction, two buckles, each engaged with a second end of each of the straps such that the straps pass through the buckles and strap tails extend outwardly from the buckles, the two buckles being oriented in essentially opposite directions and connected back-to-back to each other and not anchored to the base member, and an elongated tongue with a guide means toward a forward end of the tongue and through which the straps pass near their first ends, and the two buckles being secured to the tongue toward a rearward end of the tongue, whereby drawing the tail ends of the two straps outwardly, essentially in opposite directions from each other, will draw the binding into engagement with a user's shoe, with the tongue providing stability for the buckles as the straps are drawn tight and also providing positional consistency for the straps and buckles.

2. The binding of claim 1, wherein the tongue has a lift tab at its rear, in a position for a user to lift the tongue upwardly after releasing the two levers, to open the binding.

3. The binding of claim 1, wherein the two buckles are secured to the tongue in flexible connections.

4. The binding of claim 1, wherein the tongue is soft and pliable.

5. The binding of claim 1, wherein the guide means of the tongue comprises at least one slot through which the straps pass.

6. In a snowshoe binding that includes two straps connected at their forward ends to a base member of the binding, and which pass through low-friction loops at opposite lateral sides of the base member and then being engaged with two essentially oppositely-oriented buckles that are connected together back-to-back but not anchored to the base member, for tightening the binding over a user's shoe, the improvement comprising a tongue located substantially centrally between sides of the snowshoe, to be above the top of the shoe, the tongue being elongated in the longitudinal direction of the snowshoe binding, the two buckles being secured to the tongue in essentially back-to-back relationship at a rear portion of the tongue, whereby the tongue provides positional stability for the straps and buckles in the tightening of the binding and in the release of the binding.

7. The improvement of claim 6, wherein the tongue includes a lift tab at its rear, in a position for a user to lift the tongue upwardly after releasing the two levers, to open the binding.

8. The improvement of claim 6, wherein the tongue is soft and flexible.

9. The improvement of claim 6, wherein the two straps extend rearwardly and cross each other in a position behind the forward ends, and wherein the tongue includes a slide-permitting guide for the straps.

10. A binding for a snowshoe, comprising:

a body or base member for the binding, for attachment to a snowshoe, a pair of toe stops positioned at left and right at a front end of the base member, the toe stops being of a plastic material and extending up from the base member then back to an intersection of ends of the two toe stops, thus forming essentially two intersecting loops that are positioned to engage with and cradle the toe end of a user's shoe, an elongated tongue secured to the ends of the two toe stops, at an upper location in the binding, a pair of strap buckles secured to a rear portion of the tongue rearward of the connection to the toe stops, the two buckles being oriented essentially oppositely, a pair of straps, each having a first end connected to the toe stops and extending rearwardly and laterally outwardly therefrom, and a pair of low friction loops secured to the base member at laterally outward positions rear of the tongue, and the straps each passing through a respective one of the loops then returning to a respective buckle on the tongue, where the strap passes through the buckle and a strap tail extends from the buckle, whereby the toe stops, straps and tongue with opposed buckles form an efficient, easily deployed binding which is tightened by pulling in essentially opposite directions on the two strap tails and released by releasing the two buckles.

11. The binding of claim 10, wherein the ends of the toe stops are connected to the tongue in a pivot connection.

12. The binding of claim 11, wherein the two straps are connected to the tongue at the location where the toe stops are connected to the tongue.

13. The binding of claim 10, wherein the two straps are connected to the tongue at the location where the toe stops are connected to the tongue.

14. The binding of claim 10, wherein the two toe stops are integral with a front portion of the base member and are deflected in their looped configuration connected together at their ends, each toe stop tending to straighten in a springing manner, whereby the two toe stops tend to lift the tongue and open the binding when the straps are released.

15. The binding of claim 10, wherein the tongue is of a pliable rubbery material.

16. The binding of claim 10, wherein each of the two buckles has a release lever, and further including a release loop formed of flexible material, connected to both buckle levers and extending upwardly, to enable the user to pull up on the release loop to release both buckles and simultaneously open the binding.

17. A binding for a snowshoe, comprising:

a body or base member for the binding, for attachment to a snowshoe, a stiffening rib extending up from the front end of the base member generally in an arch shape, being deflected such that a top portion of the stiffening rib tends to spring upwardly and forwardly, an elongated tongue with a forward end secured to the top portion of the stiffening rib, a pair of strap buckles secured to a rear portion of the tongue rearward of the connection to the stiffening rib, the two buckles being oriented essentially oppositely, a pair of straps, each having a first end connected to the tongue and extending rearwardly and laterally outwardly therefrom, and a pair of low friction loops secured to the base member at laterally outward positions rear of the tongue, and the straps each passing through a respective one of the loops then returning to a respective buckle connected to the tongue, where the strap passes through the buckle and a strap tail extends from the buckle, whereby the base member, straps and tongue with opposed buckles form an efficient, easily deployed binding which is tightened by pulling in essentially opposite directions on the two strap tails, pulling the stiffening rib back and downwardly into a further deflected position, and released by releasing the two buckles and thus releasing the stiffening rib, which lifts the tongue and helps open the binding.

18. The binding of claim 17, wherein the stiffening rib comprises a pair of toe stops as integral extensions of the front end of the body or base member, the two toe stops extending up from the base member then back to an intersection and connection point of ends of the two toe stops where the toe stop ends are connected to the tongue.

19. The binding of claim 17, wherein the stiffening rib comprises an arch-shaped rib and the base member has a pair of toe stops at left and right of the front end of the base member, the stiffening rib being secured to the two toe stops in a deflected configuration tending to move the tongue upwardly and forwardly against the straps.

20. The binding of claim 19, wherein the elongated tongue comprises a generally X-shaped padded tongue secured to the stiffening rib, with the first ends of the straps secured to the forward end of the tongue at spaced apart locations.

21. The binding of claim 20, wherein the stiffening rib comprises an integrally formed component of the tongue.

22. The binding of claim 19, wherein the stiffening rib comprises an integrally formed portion of the tongue.

23. The binding of claim 19, further including a flexible release loop connected to release levers of the two buckles, whereby a wearer of the binding can pull up a release loop to release both straps simultaneously to open the binding.

24. The improvement of claim 6, wherein the binding includes a pair of toe stops positioned at left and right at a front end of the base member, and a stiffening rib comprising left and right stiffening rib legs secured to and extending up from respective left and right toe stops and joined together at upper ends of the stiffening rib legs, a forward end of the tongue being connected to the stiffening rib at the upper ends of the legs, whereby the base member, straps and tongue with opposed buckles form an efficient, easily deployed binding which is tightened by pulling in essentially opposite directions on the two strap tails, pulling the stiffening rib back and downwardly into a further deflected position, and released by releasing the two buckles and thus releasing the stiffening rib, which lifts the tongue and helps open the binding.

* * * * *